US009156592B1

(12) United States Patent
Smith

(10) Patent No.: US 9,156,592 B1
(45) Date of Patent: Oct. 13, 2015

(54) RAPID CLOSING SECURITY CONTAINER

(71) Applicant: Philip Burnie Smith, Wichita, KS (US)

(72) Inventor: Philip Burnie Smith, Wichita, KS (US)

( * ) Notice: Subject to any disclaimer, the term of this patent is extended or adjusted under 35 U.S.C. 154(b) by 0 days.

(21) Appl. No.: 14/136,520

(22) Filed: Dec. 20, 2013

Related U.S. Application Data

(60) Provisional application No. 61/746,628, filed on Dec. 28, 2012.

(51) Int. Cl.

| | |
|---|---|
| ***B65D 33/00*** | (2006.01) |
| ***B65D 33/16*** | (2006.01) |
| ***B65D 33/06*** | (2006.01) |
| ***B65D 33/28*** | (2006.01) |

(52) U.S. Cl.
CPC ..... *B65D 33/165* (2013.01); *B65D 33/06* (2013.01); *B65D 33/28* (2013.01)

(58) Field of Classification Search
CPC .. B65D 33/1666; B65D 33/165; B65D 33/06; B65D 33/28; B65B 67/1244; A45C 3/00; D06F 95/002; A01G 1/12
USPC ..... 383/12, 33, 34, 34.1, 68, 69, 35
See application file for complete search history.

(56) References Cited

U.S. PATENT DOCUMENTS

| | | | | | |
|---|---|---|---|---|---|
| 108,251 | A | * | 10/1870 | Gray | 383/68 |
| 218,333 | A | * | 8/1879 | Taylor | 383/68 |
| 302,920 | A | * | 8/1884 | Ludington | 383/68 |
| 444,527 | A | * | 1/1891 | Smith | 383/25 |
| 684,656 | A | * | 10/1901 | Watson | 383/69 |
| 1,164,833 | A | * | 12/1915 | Macaulay | 150/107 |
| 1,322,785 | A | * | 11/1919 | Buenther | 190/109 |
| 1,381,226 | A | * | 6/1921 | Pichel | 383/26 |
| 2,421,221 | A | * | 5/1947 | Rothe | 232/30 |
| 2,468,897 | A | * | 5/1949 | Rothe | 383/22 |
| 2,789,781 | A | * | 4/1957 | Miller | 248/100 |
| 3,266,711 | A | * | 8/1966 | Song | 383/13 |
| 3,707,271 | A | * | 12/1972 | Sanchez et al. | 248/101 |
| 4,248,364 | A | * | 2/1981 | Anderson | 383/6 |
| 4,646,802 | A | * | 3/1987 | Basore et al. | 220/9.4 |
| D290,538 | S | * | 6/1987 | Basore | D32/37 |
| 4,680,808 | A | * | 7/1987 | Paleschuck | 383/9 |
| 4,865,463 | A | * | 9/1989 | Howard | 383/33 |
| 5,562,225 | A | * | 10/1996 | McKenna | 220/9.1 |
| 5,667,066 | A | * | 9/1997 | Simpson | 206/278 |
| 6,074,094 | A | * | 6/2000 | Manolizi et al. | 383/5 |
| 6,149,303 | A | * | 11/2000 | Froehlich | 383/6 |
| D487,347 | S | * | 3/2004 | Felsenthal | D3/305 |
| 7,243,884 | B2 | * | 7/2007 | Lawson et al. | 248/95 |

* cited by examiner

*Primary Examiner* — Jes F Pascua
*Assistant Examiner* — Peter Helvey
(74) *Attorney, Agent, or Firm* — Neustel Law Offices

(57) ABSTRACT

A rapid closing security container which is adapted to quickly and efficiently secure various items from theft or tampering. The rapid closing security container generally includes a container having an upper opening which may be closed using a closure assembly. The closure assembly includes a first tube and a second tube which extend parallel to each other. Using a draw cord and a pair of closure cords, the first and second tubes may be drawn toward each other to close the container. A lock may be utilized to secure the draw cord and prevent the container from being opened without disengaging the lock.

9 Claims, 9 Drawing Sheets

RAPID CLOSING SECURITY CONTAINER

CROSS REFERENCE TO RELATED APPLICATIONS

I hereby claim benefit under Title 35, United States Code, Section 119(e) of U.S. provisional patent application Ser. No. 61/746,628 filed Dec. 28, 2012. The 61/746,628 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a secured container and more specifically it relates to a rapid closing security container which is adapted to quickly and efficiently secure various items from theft or tampering.

2. Description of the Related Art

Any discussion of the related art throughout the specification should in no way be considered as an admission that such related art is widely known or forms part of common general knowledge in the field.

It is increasingly important to properly secure items within containers when travelling or visiting areas in which theft is a problem. While there are a wide range of locks and containers which are currently available for securing items, these often require a large amount of maneuvering to properly lock the item therein. An individual will often find it necessary to fumble with clasps, buttons, zippers, buckles, and/or locks in securing items therein.

When the container happens to be opened when encountering a potential theft situation, an individual will often not be able to close and secure the prior art containers in a timely manner to prevent theft from the container. Alternatively, when leaving a container at a location such as in the bed of a truck, valuable time can be lost in dealing with properly securing the container and the lock to protect the items.

Because of the inherent problems with the related art, there is a need for a new and improved rapid closing security container which is adapted to quickly and efficiently secure various items from theft or tampering.

BRIEF SUMMARY OF THE INVENTION

The invention generally relates to a locking container which includes a container having an upper opening which may be closed using a closure assembly. The closure assembly includes a first tube and a second tube which extend parallel to each other. Using a draw cord and a pair of closure cords, the first and second tubes may be drawn toward each other to close the container. A lock may be utilized to secure the draw cord and prevent the container from being opened without disengaging the lock.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
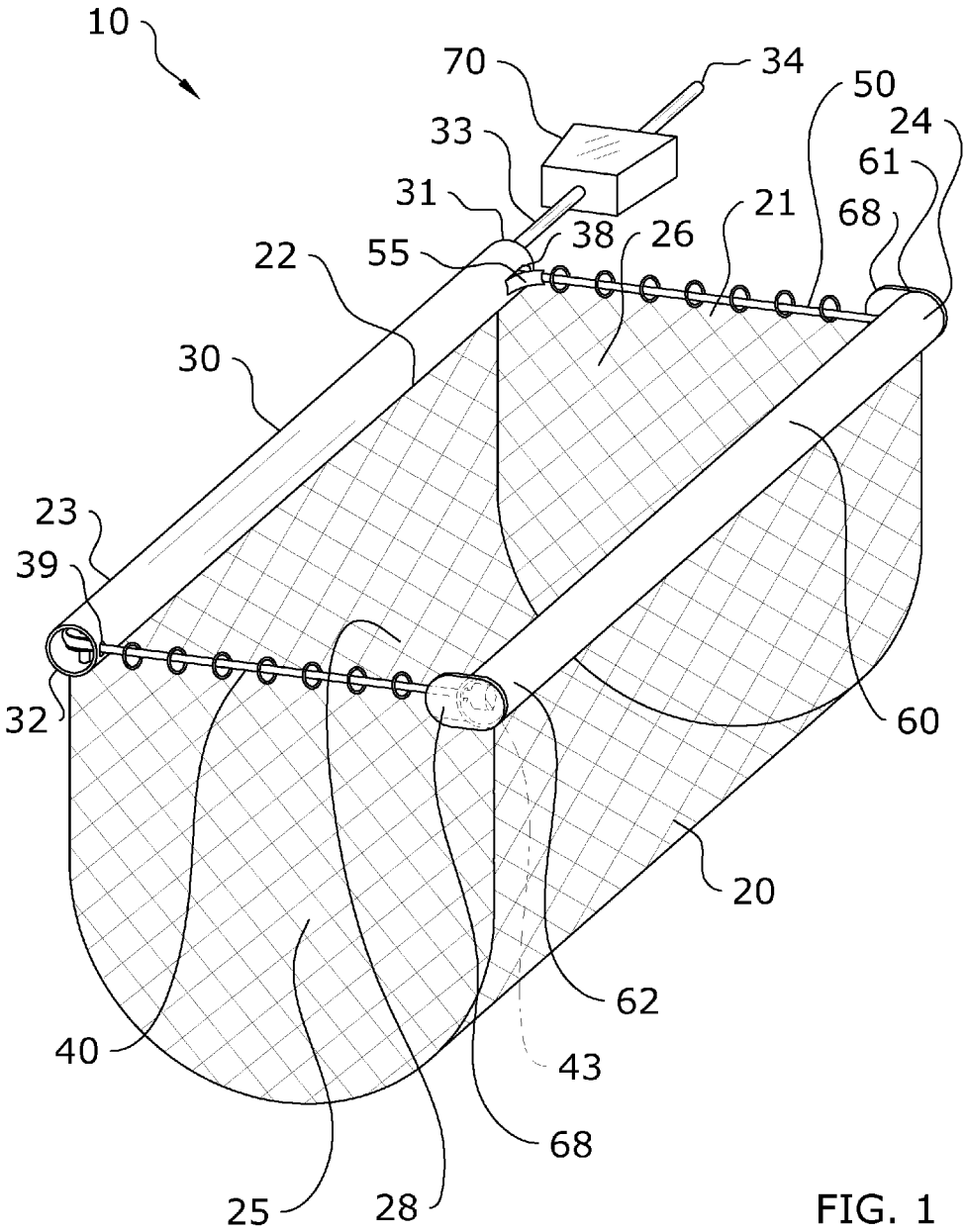
FIG. 1 is an upper perspective view of the present invention in an opened position.

Turning now descriptively to the drawings, in which similar reference characters denote similar elements throughout the several views, FIGS. 1 through 8 illustrate a rapid closing security container 10, which comprises a container 20 having an upper opening 22 which may be closed using a closure assembly. The closure assembly includes a first tube 30 and a second tube 40 which extend parallel to each other. Using a draw cord 33 and a pair of closure cords 40, 50, the first and second tubes 30, 40 may be drawn toward each other to close the container 20. A lock 70 may be utilized to secure the draw cord 33 and prevent the container 20 from being opened without disengaging the lock.

B. Container

As shown throughout the figures, the present invention includes a container 20 which is adapted to store a wide variety of items in a secured manner. The container 20 may be comprised of different shapes, sizes, and configurations to suit a range of applications. Thus, the scope of the present invention should not be construed as being limited to the shape, size, and/or configuration of the exemplary container 20 shown in the figures.

Figure 2:
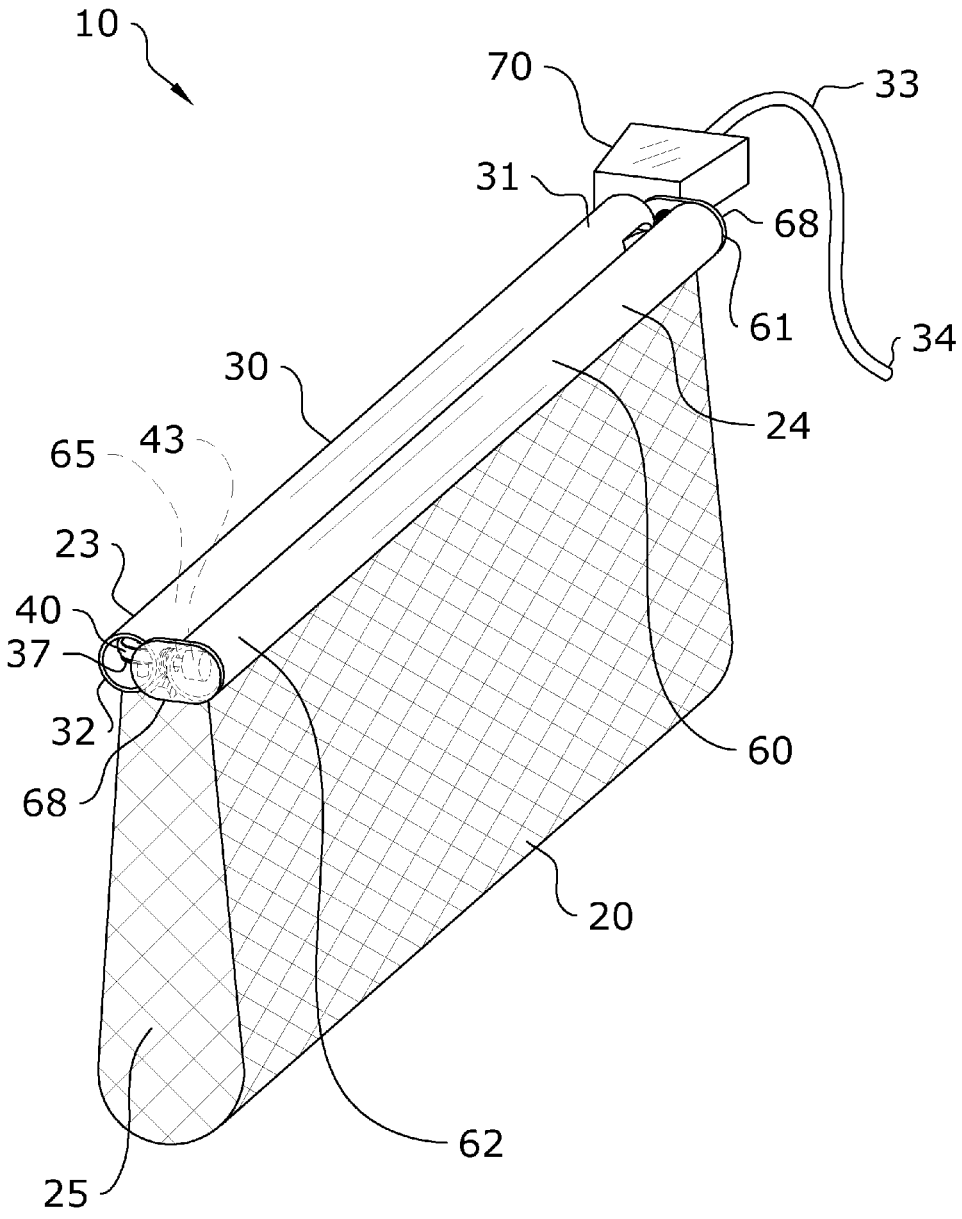
FIG. 2 is an upper perspective view of the present invention in a closed position.

The container 20 will generally include an upper end 21 which includes an upper opening 22 leading to an internal cavity 28 adapted to store and retain various items. The upper opening 22 includes a first side 23, a second side 24, a front end 25, and a rear end 26 as best shown in FIG. 1. As best shown in FIG. 2, the use of a closure assembly will cause the first side 23 and second side 24 to close together and thus enclose the internal cavity 28 to secure an item within the container 20.

The container 20 itself is preferably comprised of a flexible or partially flexible material to allow for such adjustment of its structure. In some embodiments, all of the container 20 may be comprised of the same material. In other embodiments, the front and rear portions of the container 20 may be comprised of a first material such as steel rope net while the side and bottom portions of the container 20 may be comprised of chain link fence material.

C. Closure Assembly

The present invention preferably includes a closure assembly at its upper end 21 which is adapted to secure the first side 23 and second side 24 of the upper opening 22 together so as to close the upper opening 22 and enclose the cavity 28 as shown in FIGS. 2 and 5-8. While there are a wide range of configurations for the closure assembly, a preferred embodiment as shown in the figures includes a pair of parallel tubes 30, 60, a draw cord 33, and a pair of closure cords 40, 50.

As best shown in FIGS. 1 and 2, a first tube 30 will extend along the first side 23 of the upper opening 22 between its front end 25 and its rear end 26. The first tube 30 is preferably comprised of a cylindrical elongated member made of a rigid material. A first end 31 of the first tube 30 is positioned adjacent to the first side 23 and rear end 26 of the upper opening 22 and a second end 32 of the first tube 30 is positioned adjacent to the first side 23 and front end 25 of the upper opening 22.

The second tube 60 extends parallel with respect to the first tube 30 along the second side 24 of the upper opening 22 between its front end 25 and its rear end 26. The second tube 60 is also preferably comprised of a cylindrical elongated member made of a rigid material. A first end 61 of the second tube 60 is positioned adjacent to the second side 24 and rear end 26 of the upper opening 22 and a second end 62 of the second tube 60 is positioned adjacent to the second side 24 and front end 25 of the upper opening 22.

As shown in FIGS. 1-7, the second tube 60 may include a pair of shrouds 68 covering each of its openings 64, 65. In a preferred embodiment, each shroud 68 will comprise a structure such as a metal or plastic tab which fits over each opening 64, 65 to prevent access to and manipulation of closure cords 40, 50 of the second tube 60 or stoppers 43, 53. The shrouds 68 may be fixedly secured to the ends 61, 62 of the second tube 60 or may be removably connected thereto.

The tubes 30, 60 extend parallel with each other in spaced-apart relationship when the container 20 is open as shown in FIG. 1 and abut against each other when the container 20 is closed as shown in FIG. 2. The tubes 30, 60 may be secured to the container 20 using various structures or methods (i.e. with adhesives, clasps, welding, etc.) or may be integrally formed with the container 20.

Figure 4:
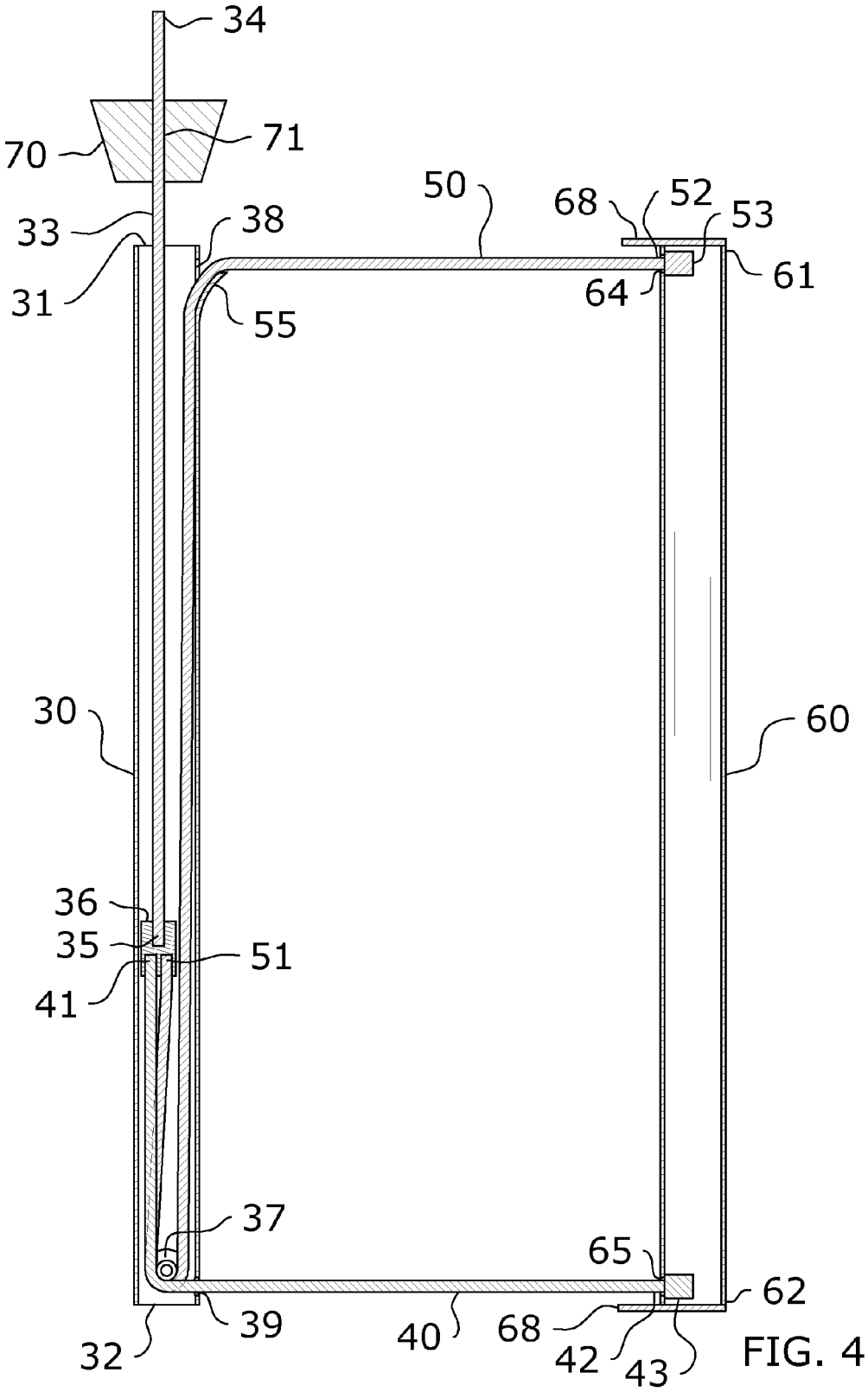
FIG. 4 is a top sectional view taken along line 4-4 of FIG. 3.
Figure 5:
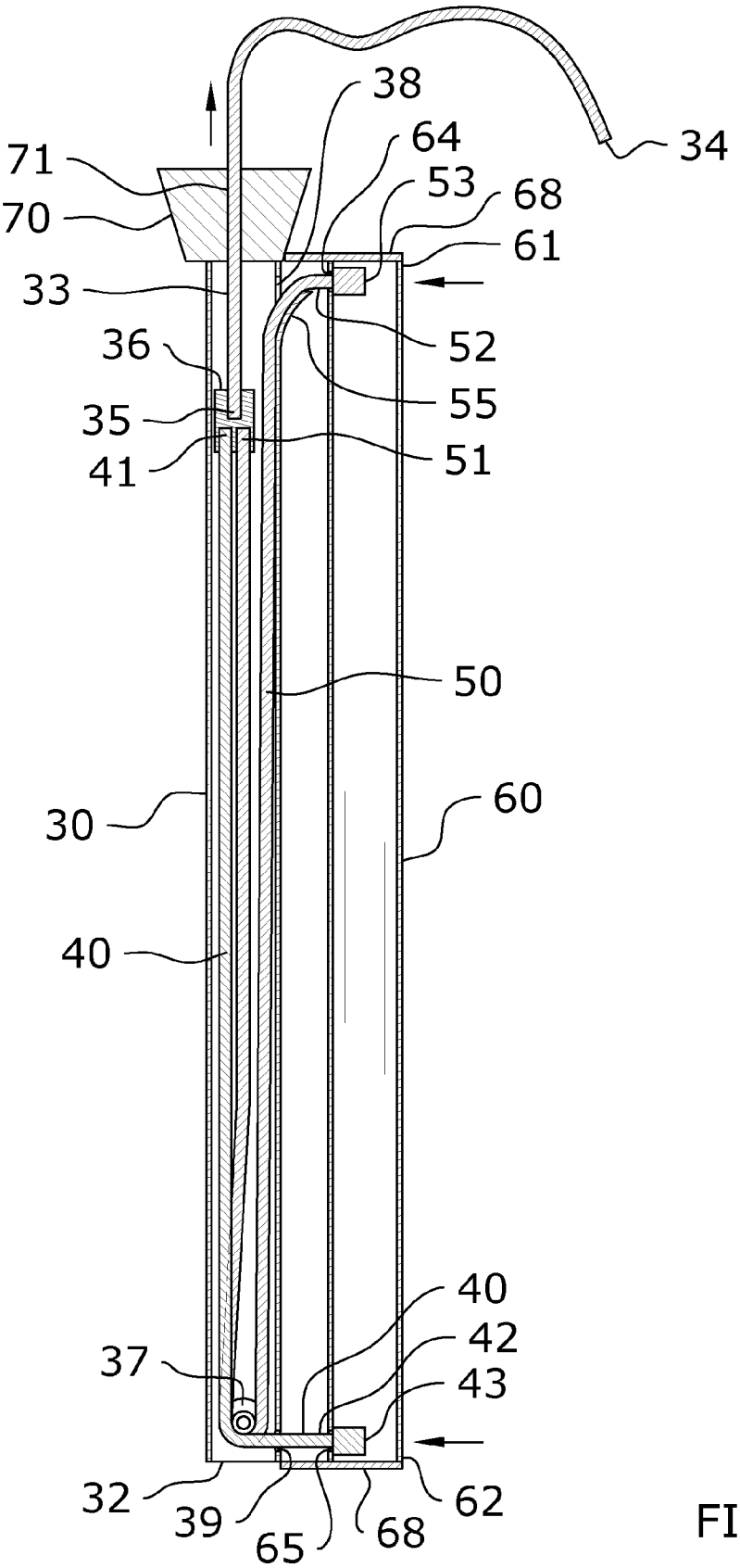
FIG. 5 is a top sectional view of the present invention in a closed position.

As shown throughout the figures, the first tube 30 includes a draw cord 33 extending out of its first end 31. The draw cord 33 may be pulled outwardly to cinch close the container 30 by drawing the first and second tubes 30, 60 toward each other to enclose the cavity 28. The draw cord 33 includes a first end 34 which extends out of the first end 31 of the first tube 30 and a second end 35 which is secured to an anchor 36 which is movably positioned within the first tube 30 as shown in FIGS. 4 and 5. The anchor 36 may be comprised of any structure which may be movably (i.e. slidably) positioned within the first tube 30 and to which the various cords 33, 40, 50 of the present invention may be fixedly secured.

As best shown in FIGS. 4 and 5, a first closure cord 40 and a second closure cord 50 are each secured to an opposite end of the anchor 36 as the draw cord 33. The closure cords 40, 50 act to pull the second tube 60 toward the first tube 30 to close the container 20 when the draw cord 33 is pulled upon. A pulley 37 is included within the first tube 30, preferably adjacent to its second end 32, around which the closure cords 40, 50 extend before connecting to the second tube 60.

The first closure cord 40 is connected at its first end 41 to the anchor 36 at a position opposite to the connection point of the draw cord 33. The first closure cord 40 extends around the pulley 37 and forms a right angle as shown in FIG. 4. The first closure cord 40 exits the first tube 30 through a second opening 39 thereof which is positioned along an inner surface of the first tube 30 adjacent to its second end 32.

The second end 42 of the first closure cord 40 is fixedly secured to the second tube 60, preferably at a position adjacent to its second end 62 along its inner surface. In a preferred embodiment as shown in FIG. 4, the second end 42 of the first closure cord 40 enters the second tube 60 via a second opening 65 thereof and is secured to the second tube 60 via a stopper 43 or other structure which anchors the second end 42 of the first closure cord 40 to the second tube 60.

The second closure cord 50 is connected at its first end 51 to the anchor 36 at a positioned opposite to the connection point of the draw cord 33 alongside the connection point of the first closure cord 40 as best shown in FIGS. 4 and 5. The second closure cord 50 extends around the pulley 37 and doubles back upon itself, extending for the length of the first tube 30 parallel to the draw cord 33 and the pre-pulley portion of the second closure cord 50.

The second closure cord 50 exits the first tube 30 through a first opening 38 thereof which is positioned along an inner surface of the first tube 30 adjacent to its first end 31. A guide member 55 may be included along the first opening 38 of the first tube 30 as shown in FIG. 4 which extends diagonally and guides the exiting portion of the second closure cord 50 to extend between the first and second tubes 30, 60 perpendicularly with respect to the tubes 30, 60. The guide member 55 allows for smoother closure of the tubes 30, 60 and will prevent abrasion or other structural damage to the second closure cord 50 as it comes out of the first tube 30.

The second end 52 of the second closure cord 50 is fixedly secured to the second tube 60, preferably at a position adjacent to its first end 61 along its inner surface. In a preferred embodiment as shown in FIG. 4, the second end 52 of the second closure cord 50 enters the second tube 60 via a first opening 64 thereof and is secured to the second tube 60 via a stopper 53 or other structure which anchors the second end 52 of the second closure cord 50 to the second tube 60.

Figure 3:
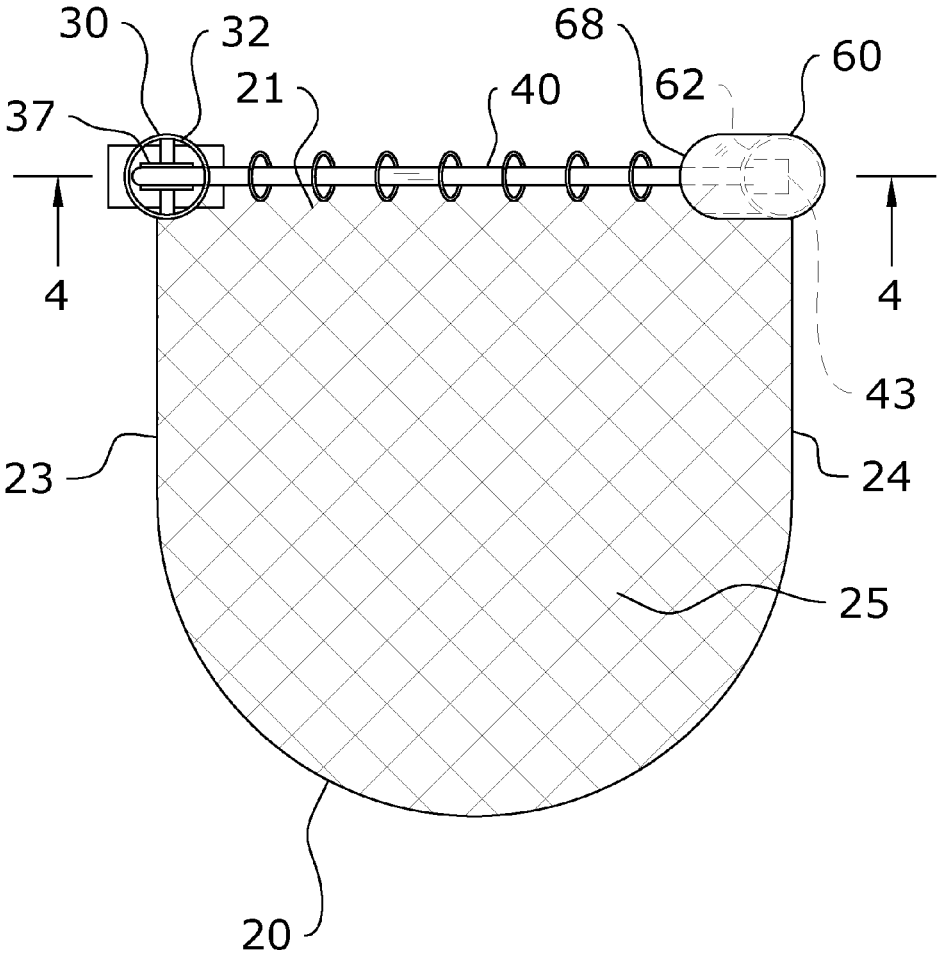
FIG. 3 is a frontal view of the present invention in an opened position.

The container 20 may also be secured to the closure cords 40, 50 as best shown in FIGS. 1 and 3. In embodiments where the container 20 is comprised of netting such as zoo mesh fabric, the closure cords 40, 50 may weave through the netting. In other embodiments, separately looped materials or devices may link the container 20 with the closure cords 40, 50.

Figure 9:
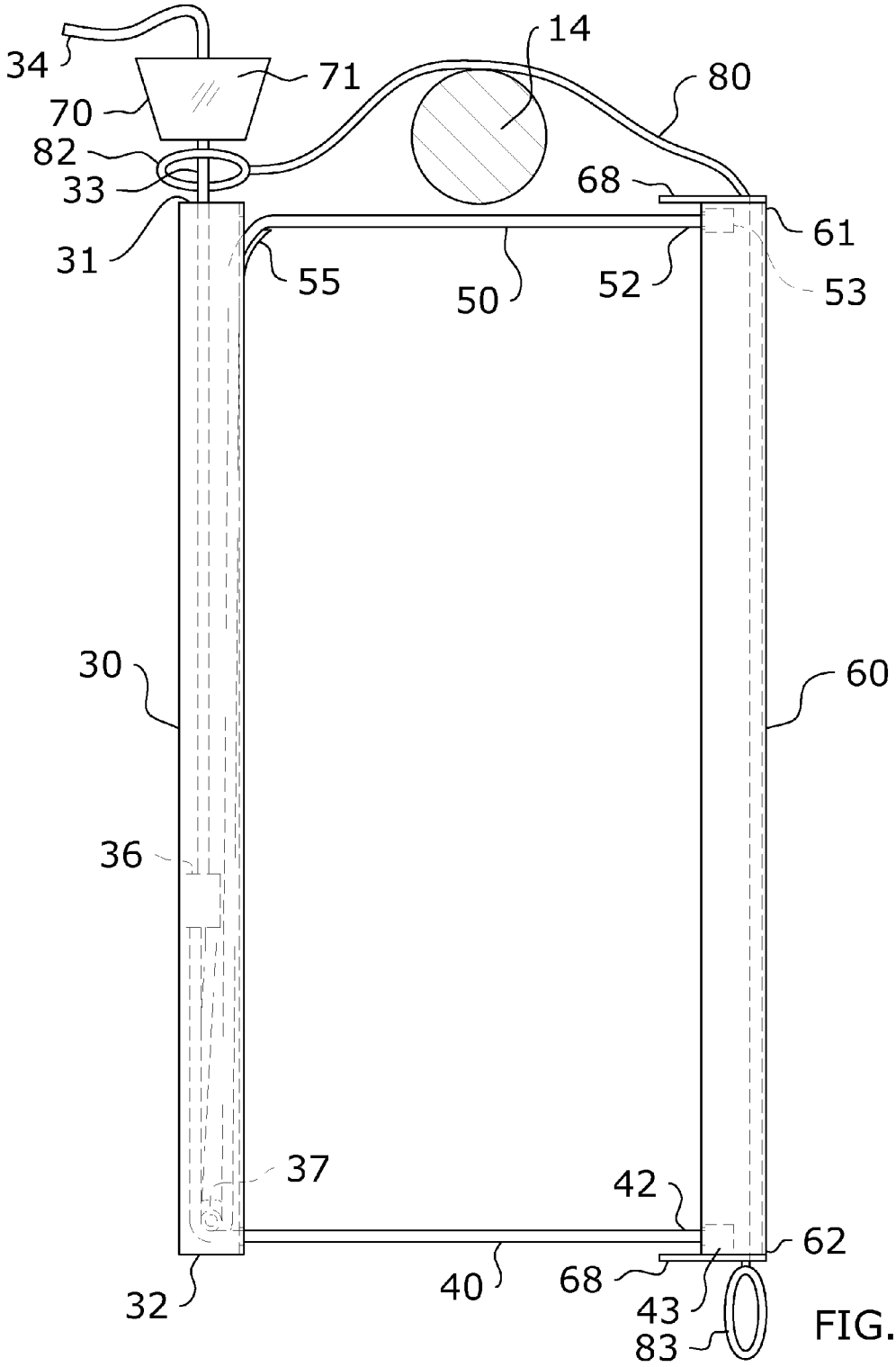
FIG. 9 is an upper perspective view of the present invention in an open position secured around a structure with an alternative locking cord.

As shown throughout the figures, a lock 70 is included on the draw cord 33 which will allow the container 20 to be locked in a closed position in a first direction and thus secure the contents of the cavity 28. The lock 70 preferably include a channel 71 extending therethrough as well as a locking mechanism which causes the channel 71 to lockably secure in a cinch position around the draw cord 33. The draw cord 33 slidably extends through the channel 71 as shown in the figures when the locking mechanism is disengaged allowing lock 70 to slide in first and second directions. When engaged, the lock 70 will prevent movement of the draw cord 33 within the channel 71 in the second direction and thus prevent the container 20 from being opened without release of the lock 70 permitting movement in the second direction. When engaged, the lock 70 will prevent movement of the lock 70 in the second direction allowing it to accommodate locking cord 80 for securely anchoring the container in an open cavity condition as shown in FIG. 9.

More specifically, the lock 70 has various operational positions in which the draw cord 33 may be manipulated to form substantially any sized loop with the container 20. The lock 70 includes an unlocked position in which the draw cord 33 is slidably receivable in the first tube 30. In the unlocked position, the draw cord 33 is also slidably removably in a second direction, opposite the direction of insertion, to form larger loops with the container 20 and eventually to be removed from the container 20 for releasing the objects secured.

The lock 70 has a first locked position, or a cinch position, in which the draw cord 33 is also slidably receivable in the first direction. The cinch position differs from the unlocked position, however, in that the draw cord 33 cannot be released in the second direction. The draw cord 33 is prevented from movement in the second direction through the container 20 and is only allowed to move in the first direction to allow the user great ease in tightening or cinching the draw cord 33 around the object and fixture.

D. Attachments

Figure 6:
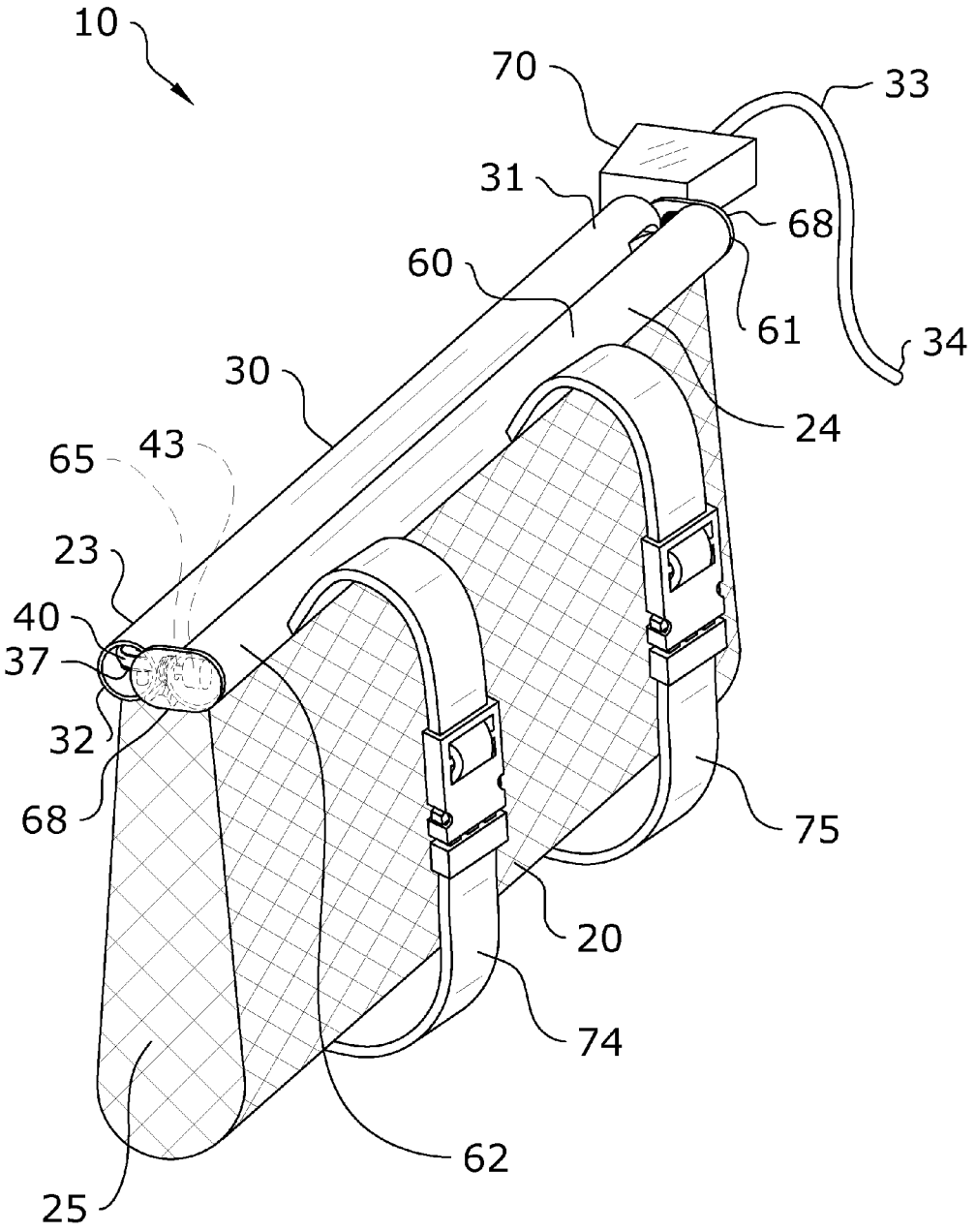
FIG. 6 is an upper perspective view of the present invention with a pair of attached straps to function as a backpack.
Figure 7:
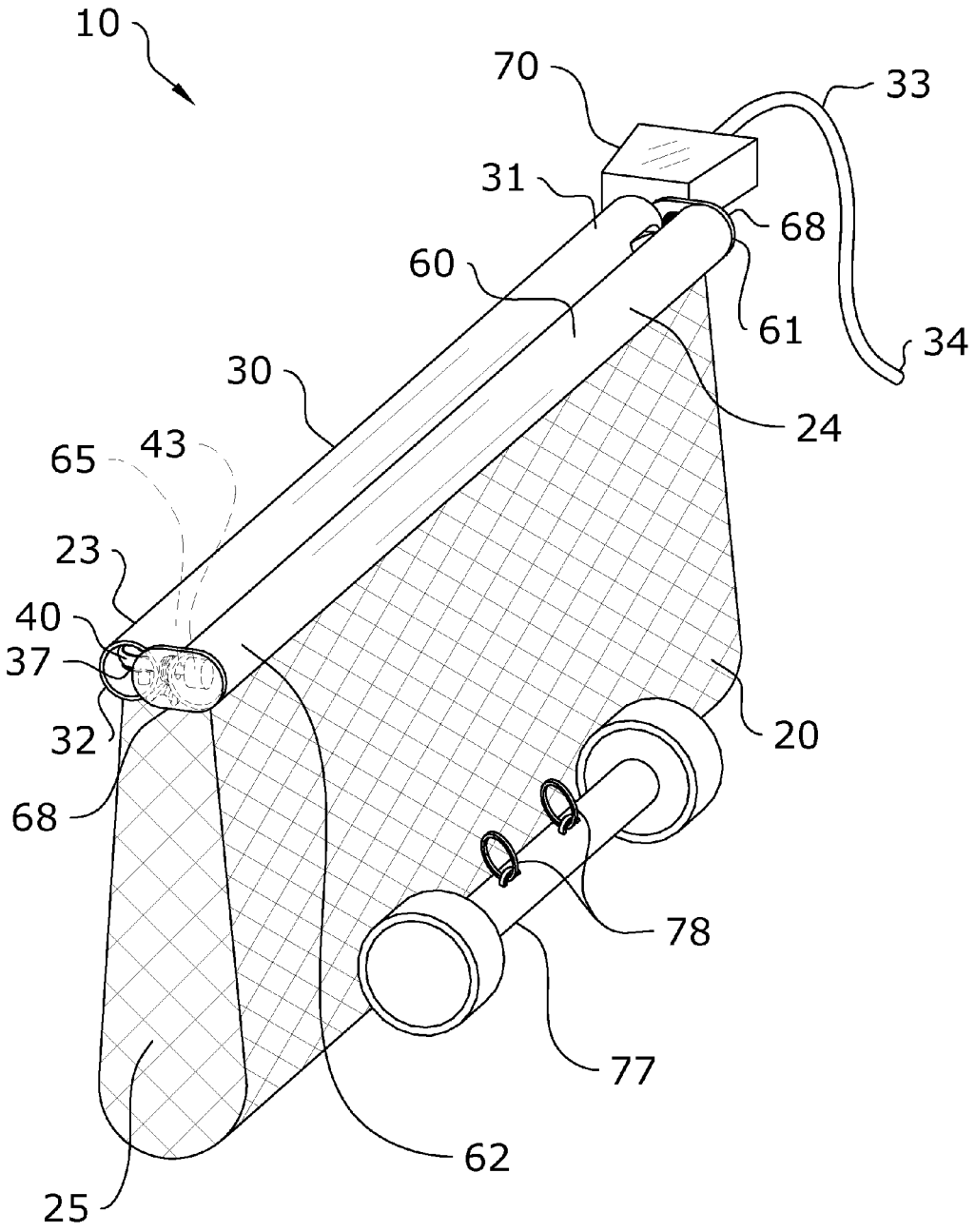
FIG. 7 is an upper perspective view of the present invention with a rolling assembly secured thereto with a pair of clasps.

A variety of attachments may be utilized in combination with the present invention. FIG. 6 illustrates an embodiment which utilizes a first strap 74 and a second strap 75 which are secured to the outer portion of the container 20 so that the container 20 may be worn as a backpack. FIG. 7 illustrates a rolling assembly 77 which may be secured to the container 20 via clasps 78 to allow the container 20 to be rolled along the ground.

Figure 8:
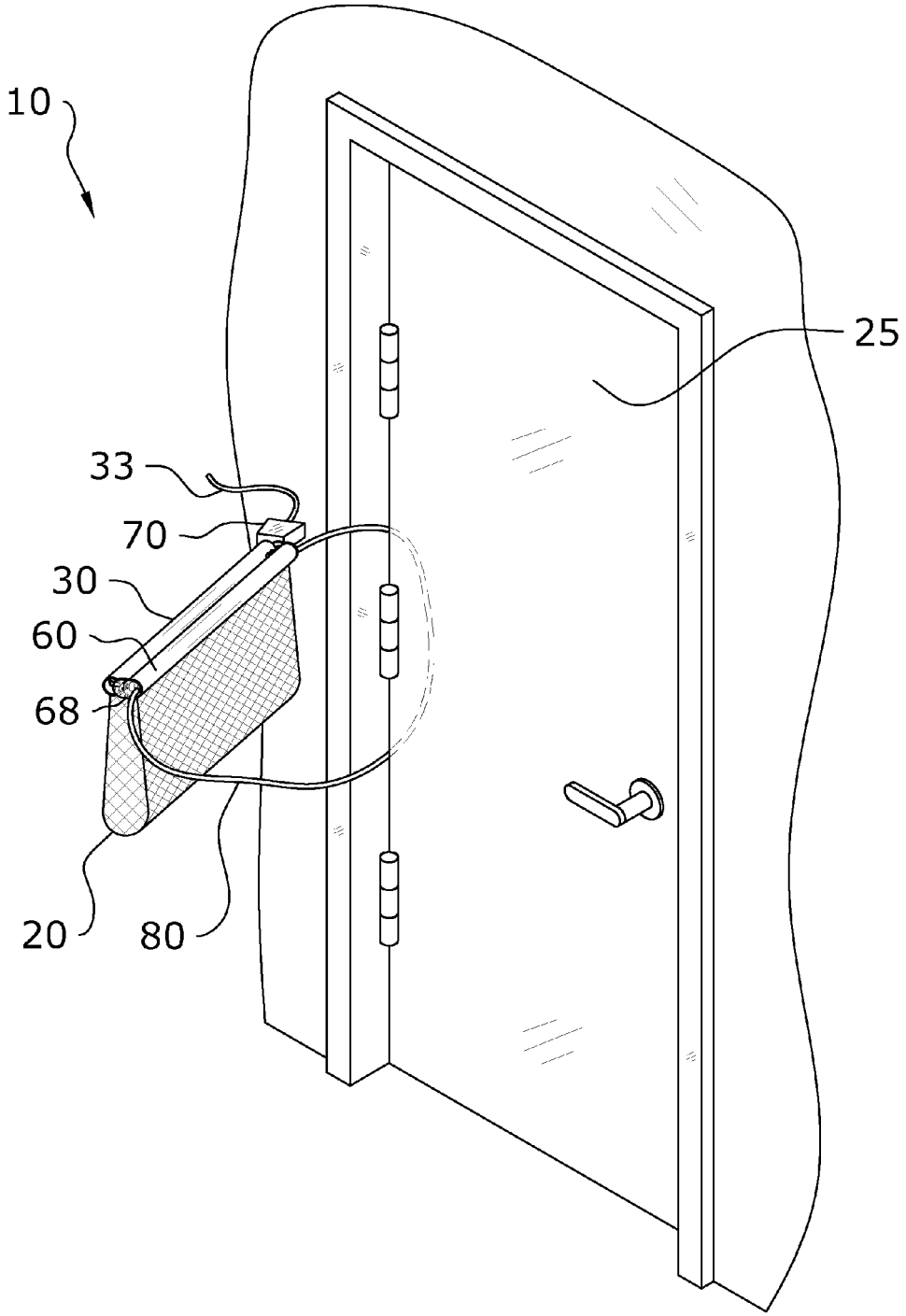
FIG. 8 is an upper perspective view of the present invention in a closed position secured within a door using a locking cord.

FIG. 8 illustrates a locking cord 80 which may be threaded through one of the tubes 60 and then looped around a structure, such as a door 12 hinge or railing within a truck bed. FIG. 9 illustrates an alternate embodiment of the locking cord 80, wherein the locking cord 80 includes a first loop 82 at a first end thereof and a second loop 83 at a second end thereof. This locking cord 80 configuration may be utilized to secure the present invention when in its opened state. The first loop 82 is secured around the draw cord 33 between the lock 70 and the first end 31 of the first tube 30 as shown in FIG. 9. The locking cord 80 may then be extended around an anchoring structure 14 and through the second tube 60. The second loop 83 may be secured to another structure to lock the present invention when in its opened state.

E. Operation of Preferred Embodiment

In use, the container 20 will initially be in an opened position as shown in FIGS. 1, 3, and 4. An item may be placed within the container 20 to be secured therein. After positioning any items within the container 20, the locking assembly may be closed to secure the item therein as best shown in FIGS. 4 and 5. The draw cord 33 is pulled outwardly through the lock 70. The drawing motion on the draw cord 33 pulls the anchor 36 as well as the first and second closure cords 40, 50 secured thereto. By use of the pulley 37, the first and second closure cords 40, 50 are drawn inwardly, which rapidly pulls the second tube 60 up against the first tube 30 in a configuration best shown in FIGS. 2 and 5.

The lock 70 may then be engaged against or near the first end 31 of the first tube 30 to prevent the draw cord 33 from further motion and thus lock the container 20 in a closed position. The container 20 may then be secured to various items such as a truck bed or door or worn for transport. The tubes 30, 60 may be utilized as handles when the container 20 is in the closed position.

When needed, the lock 70 may be disengaged to allow the draw cord 33 to freely move therethrough. The tubes 30, 60 may then be freely pulled apart, which will draw the draw cord 33 back into the first tube 30.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A rapid closing security container, comprising:

a container, wherein said container includes an upper opening and a cavity;

a first tube positioned along a first side of said upper opening;

a second tube positioned along a second side of said upper opening, wherein said first tube and said second tube are parallel, wherein said closure assembly includes a draw string, said draw string being operable to draw said first tube and said second tube together to close said container, wherein said draw string is movably positioned within said first tube;

a closure assembly adapted to draw said first tube and said second tube together to close said container, wherein said closure assembly includes a lock, said lock being operable in an engaged position to lock said first tube against said second tube and in a disengaged position to allow said first tube and said second tube to be freely movable; and an anchor movably positioned within said first tube, wherein a first end of said draw string extends out of a first end of said first tube and wherein a second end of said draw string is secured to said anchor.

2. The rapid closing security container of claim 1, further comprising a first closure cord connecting said first tube with said second tube.

3. The rapid closing security container of claim 2, wherein a first end of said first closure cord is secured to said anchor and wherein a second end of said first closure cord is secured to said second tube.

4. The rapid closing security container of claim 3, wherein said first closure cord extends around a pulley, wherein said pulley is positioned within said first tube adjacent to a second end thereof.

5. The rapid closing security container of claim 4, wherein said further comprising a second closure cord connecting said first tube with said second tube.

6. The rapid closing security container of claim 5, wherein a first end of said second closure cord is secured to said anchor and wherein a second end of said second closure cord is secured to said second tube.

7. The rapid closing security container of claim 6, wherein said second end of said first closure cord is secured to a first end of said second tube and wherein a second end of said second closure cord is secured to a second end of said second tube.

8. The rapid closing security container of claim 6, wherein said second closure cord extends around said pulley.

9. The rapid closing security container of claim 8, wherein said lock is positioned around said draw string.

* * * * *